United States Patent [19]

Streubel et al.

[11] Patent Number: 5,036,902

[45] Date of Patent: Aug. 6, 1991

[54] CONTINUOUS CASTING PLANT FOR CASTING BEAM BLANKS

[75] Inventors: Hans Streubel, Erkrath; Georg Engel, Kaarst; Hugo Feldmann, Alsdorf-Warden, all of Fed. Rep. of Germany

[73] Assignee: SMS Schloemann-Siemag Aktiengesellschaft, Düsseldorf, Fed. Rep. of Germany

[21] Appl. No.: 493,010

[22] Filed: Mar. 13, 1990

[30] Foreign Application Priority Data

Mar. 18, 1989 [DE] Fed. Rep. of Germany ..... 3909009

[51] Int. Cl.[5] ..... B22D 11/04; B22D 11/00

[52] U.S. Cl. ..... 164/491; 164/436; 164/418; 164/442; 164/476

[58] Field of Search ..... 164/491, 459, 418, 436, 164/442, 484, 417, 476

[56] References Cited

U.S. PATENT DOCUMENTS

| | | | |
|---|---|---|---|
| 4,640,338 | 2/1987 | Kumagai | 164/442 |
| 4,805,685 | 2/1989 | Lorento | 164/459 |

FOREIGN PATENT DOCUMENTS

| | | | |
|---|---|---|---|
| 56-6707 | 1/1981 | Japan | 164/442 |
| 59-39456 | 3/1984 | Japan | 164/459 |
| 59-50961 | 3/1984 | Japan | 164/442 |
| 59-212156 | 12/1984 | Japan | 164/484 |
| 60-83743 | 5/1985 | Japan | 164/491 |
| 63-171255 | 7/1988 | Japan | 164/476 |

*Primary Examiner*—Kuang Y. Lin

*Attorney, Agent, or Firm*—Toren, McGeady & Associates

[57] ABSTRACT

A continuous casting plant for casting beam blanks to be used in rolling section steel. The continuous casting plant includes a cooled mold and a strand guide arrangement following the mold. The mold has two side walls which each define a web surface, two expanding surfaces and two parallel adjusting surfaces. End rolls are adjustably mounted between the adjusting surfaces. The expanding surfaces of the mold are inclined at an angle of 20° to 45° relative to the plane of the web surface. Guide rollers are arranged in alignment with and following the web surfaces, the expanding surfaces and the adjusting surfaces of the mold. The adjustable end rolls are provided with sections which project into the mold space. Guide elements are arranged following the end walls, the guide elements being adjustable in the same direction.

7 Claims, 3 Drawing Sheets

CONTINUOUS CASTING PLANT FOR CASTING BEAM BLANKS

BACKGROUND OF THE INVENTION

1. Field of the Invention

The present invention relates to a continuous casting plant for casting beam blanks to be used in rolling section steel. The continuous casting plant includes a cooled mold and a strand guide arrangement following the mold. The mold has two side walls which each have a web surface, two expanding surfaces and two parallel adjusting surfaces, wherein end walls are adjustably mounted between the adjusting surfaces.

2. Description of the Related Art

German Offenlegungsschrift 2,218,408 discloses a mold for casting beam blanks to be used in rolling beams, where~~in,~~ for adjusting the beam blank to the finished section, the end walls of the mold can be adjusted by means of spindles between parallel adjusting surfaces of the side walls. In this mold, the expanding surfaces include an angle of 75° to the planes of the web surfaces. A mold of this type has the disadvantage that it is only possible to pass beam blanks within a small range of dimensions of the beams to be rolled. Another disadvantage of this mold is that shrinkage may cause the beam blank to be jammed in the mold space.

It is, therefore, the primary object of the present invention to make the manufacture of section steel more economical. Specifically, a continuous casting plant for manufacturing beam blanks to be used in rolling section steel is to be provided which is structurally simple and has a high availability. Moreover, the continuous casting plant is to be capable of casting beam blanks by means of a small number of molds and the beam blanks are to be shaped such that they can be rolled with a small number of passes and rolling units in an energy-saving and productivity-increasing manner into a plurality of finished shapes and finished dimensions.

SUMMARY OF THE INVENTION

In accordance with the present invention, the expanding surfaces of the mold are inclined at an angle $\alpha$ of 20° to 45° relative to the plane of the web surface; strand guide rollers are arranged in alignment with and following the web surfaces, expanding surfaces and adjusting surfaces of the mold; the adjustable end walls are provided with projections which project into the mold space; and guide elements are arranged following the end walls, wherein the guide elements are adjustable in the same direction.

The continuous casting plant according to the present invention makes it possible to cast in an economical manner and with a small number of molds beam blanks having a crack-free surface and a good structure, wherein the beam blanks can be rolled with a small number of total passes into beams, rails, sheet piles and other section steels.

In accordance with a particularly advantageous feature of the invention, the guide elements following the end walls are provided with slide surfaces for the end faces of the beam blanks.

In accordance with another feature, the rollers associated with the expanding surfaces are provided in an alternating arrangement with the rollers associated with the web surfaces and the adjusting surfaces.

In a method for operating a continuous casting plant, the end walls of the continuous casting mold and the strand guide elements following the end walls are adjusted for changing the profile of thickened portions of the beam blank during the casting operation. This makes it possible to cast several different orders in a long casting sequence.

In a cast beam blank for use in rolling sectional steel, a middle web is widened on both sides with an angle of 40° to 90° to form a lateral increased thickness portion each. The end faces of the increased thickness portions each have a recess. A particular advantage of such a beam blank is that centering of the beam blank occurs already during the first pass.

The cast beam blank is used for hot rolling in a subsequent finishing mill for producing beams with parallel flanges, U-sections, sheet piles, etc.

The various features of novelty which characterize the invention are pointed out with particularity in the claims annexed to and forming a part of this disclosure. For a better understanding of the invention, its operating advantages and specific objects attained by its use, reference should be had to the drawing and descriptive matter in which there is illustrated and described a preferred embodiment of the invention.

DESCRIPTION OF THE PREFERRED EMBODIMENT

Figure 1:
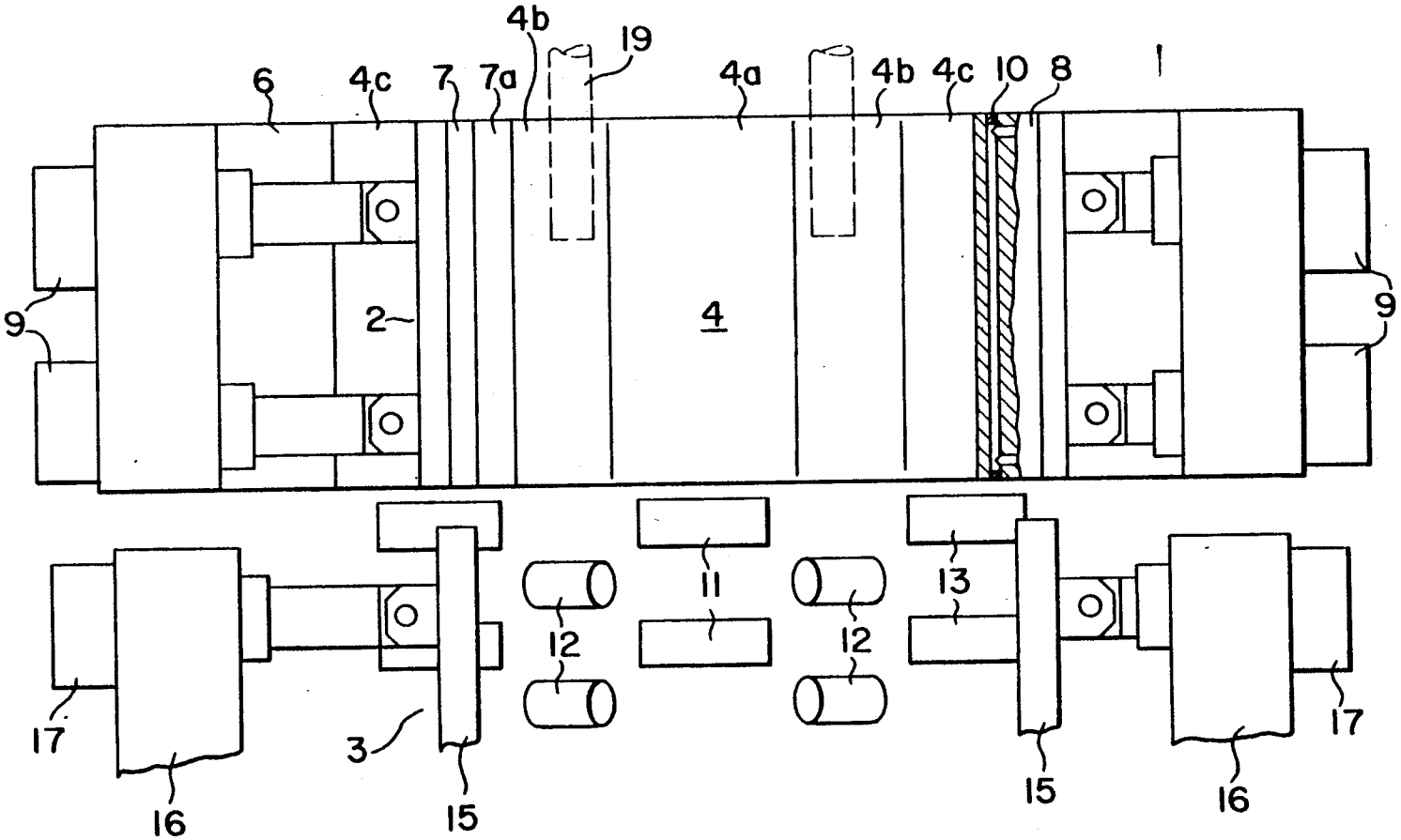
FIG. 1 is a longitudinal sectional view of a continuous casting plant including a mold and a subsequent strand guide arrangement.

As illustrated in FIG. 1, a continuous casting plant for beam blanks 1 to be used for rolling section steel includes a slab mold 2 and a subsequent stand guide arrangement 3.

Figure 2:
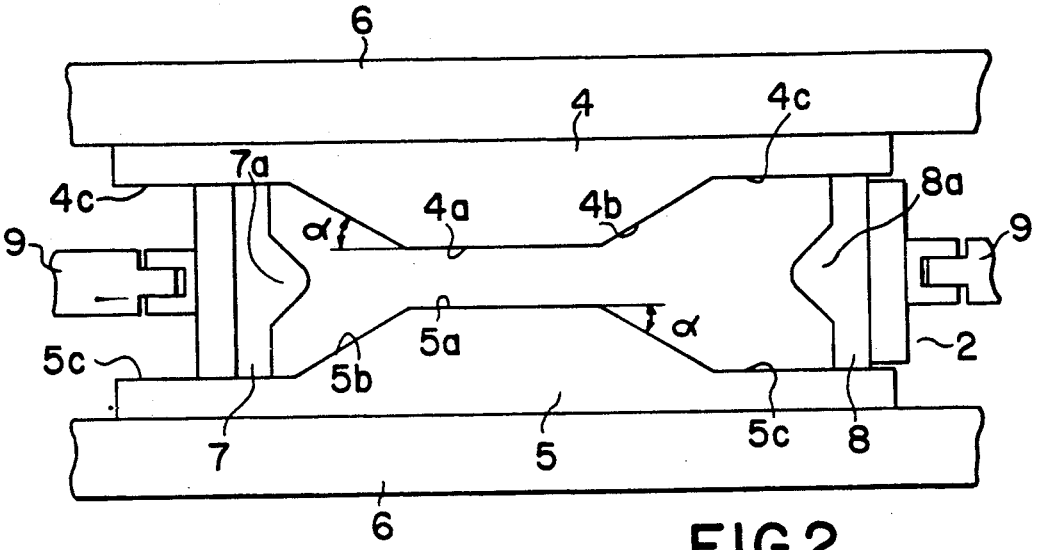
FIG. 2 is a top view of the mold.

As shown in FIG. 2, two side walls 4, 5 are mounted on a support frame 6. Each side wall 4, 5 has a web surface 4*a*, 4*a* in the middle, two expanding surfaces 4*b*, 5*b* adjacent the web surface and two adjusting surfaces 4*c*, 5*c* adjacent the expanding surfaces. In the illustrated embodiment, the expanding surfaces 4*b*, 5*b* include an angle $\alpha = 30°$ with the planes of the web surfaces 4*a*, 5*a*. End walls 7, 8 serving as lateral ends of the mold space are arranged between the parallel adjusting surfaces 4*c*, 5*c*. The end walls 7, 8 are adjustable by means of spindle drives 9 in order to change the beam blank cross-sections. Each end wall 7, 8 has a projection 7*a*, 8*a* which projects into the mold space and which form a recess 1*d* in the beam blank 1. The side walls 4, 5 and the end walls 7, 8 are provided with cooling ducts 10.

The mold is supplied with steel through one or two pouring tubes 19. The pouring tubes 19 are advantageously arranged in the space of the mold 2 which is defined by the expanding surfaces 4*b*, 5*b*, the adjusting surfaces 4*c*, 5*c* and the end walls 7, 8 and, thus, the pouring tubes 19 do not have to be adjusted when the beam blank cross-section is changed.

Figure 3:
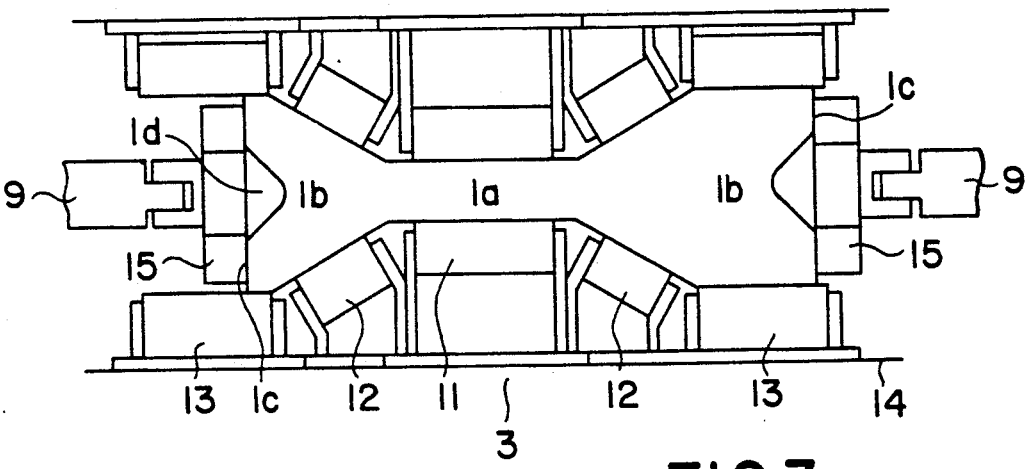
FIG. 3 is a top view of the strand guide arrangement.

As illustrated in FIGS. 1 and 3, the strand guide arrangement which follows the mold 2 and is arranged in alignment with the mold side walls 4, 5 is composed of web guide rollers 11, expanding guide rollers 12 and end guide rollers 13 which are supported within a frame 14. As shown in FIG. 1, the web guide rollers 11 and the end guide rollers 13 are mounted in an alternating arrangement with the expanding guide rollers 12.

Guide rails 15 are arranged in alignment with the end walls 7, 8. The guide rails 15 can be adjusted by means of spindle drives 17 in accordance with the adjustment of the end walls 7, 8. The guide rails 15 support end faces 1*c* of the beam blank 1 which extend perpendicularly to the web 1*a*.

Figure 4:
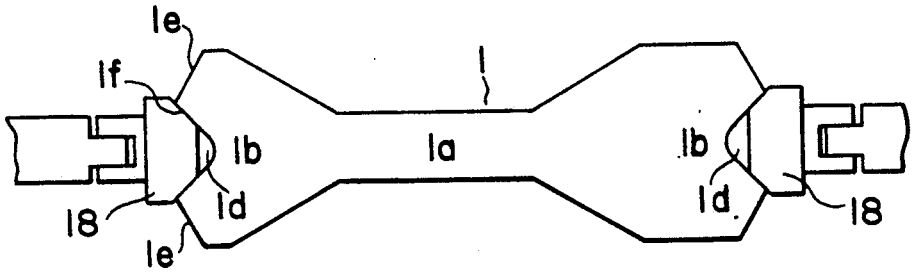
FIG. 4 shows a different guide means for the end faces of the beam blank.

The cast beam blank 1 has a middle web 1*a* which widens with an angle $\alpha = 60°$ toward a lateral increased thickness portion 1*b* each. The end faces of the beam blank are defined by surfaces 1*c* which extend perpendicularly to the web 1*a* and by a middle recess 1*d*. As shown in FIG. 4, the end faces 1*e* extend at an obtuse angle relative to each other. In this case, due to the self-support in the edge regions, the support can also be carried out by means of guide runners 18 in the regions of the recesses 1*d*.

The continuous casting plant described above is operated as follows. Prior to the beginning of the casting operation, the mold 2 is closed in the known manner by means of a dummy bar head and the water cooling system 10 is switched on. The mold 2 is then filled through pouring tubes 19. When the steel in the mold has reached a certain filling level, the strand withdrawal mechanism and the mold oscillating mechanism are started.

The beam blank 1 conducted from the mold 2 is supported at the longitudinal sides thereof by means of the web guide rollers 11, the expanding guide rollers 12 and the end guide rollers 13. The end faces are supported by the guide elements 15 or 18.

To adapt the beam blank to a wide range of finished sections, the end walls 7, 8 of the mold can be adjusted in order to cast beam blanks 1 having increased thickness portions 1*b* of different sizes. As seen in FIGS. 1 and 2, the left side is adjusted for a narrow and small increased thickness portion and the right side is adjusted for a large increased thickness portion. Other adjustments of the end walls 7, 8 are possible for special sections.

Thus, by a defined adjustment of the end walls 7, 8 in order to increase or decrease the size of the increased thickness portions 1*b* and a corresponding adjustment of the guide elements 15 or 18, long casting sequences are possible even when the orders are relatively small.

Figure 5:
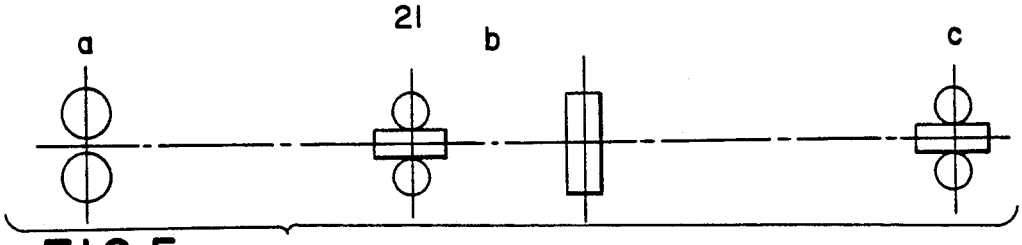
FIG. 5 schematically shows a finishing mill for hot rolling the beam blanks.
Figure 6A:
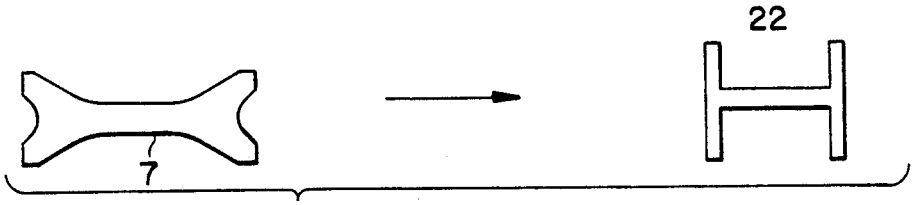
FIG. 6*a* shows a beam with parallel flanges produced in the finishing mill of FIG. 5.
Figure 6B:
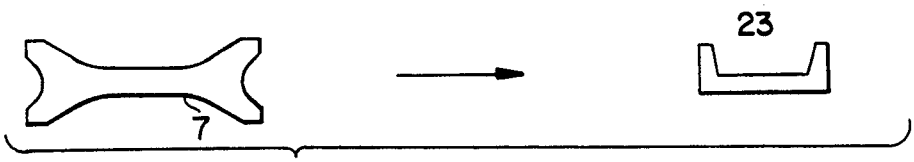
FIG. 6*b* shows a U-section produced in the finishing mill of FIG. 5.
Figure 6C:
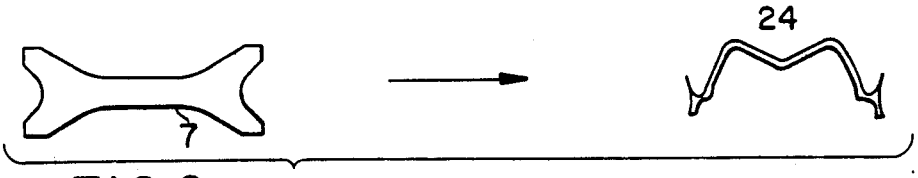
FIG. 6*c* shows a sheet pile produced in the finishing mill of FIG. 5.

FIG. 5 of the drawing schematically shows a finishing mill 21 for hot rolling the cast beam blanks. The finishing mill 21 includes a break-down stand a, a universal roughing group b and a universal finishing stand c. The finishing mill 21 is used for rolling the beam blanks into beams with parallel flanges, as illustrated in FIG. 6*a*, into U-sections, as shown in FIG. 6*b*, and into sheet piles, as shown in FIG. 6*c*.

While a specific embodiment of the invention has been shown and described in detail to illustrate the application of the inventive principles, it will be understood that the invention may be embodied otherwise without departing from such principles.

What is claimed is:

1. In a continuous casting plant for casting beam blanks to be used in rolling section steel, the continuous casting plant including a cooled mold and a strand guide arrangement following the mold, the mold having walls which define two web surfaces, four parallel adjusting surfaces and four expanding surfaces, each expanding surface being adjacent one web surface and one adjusting surface, the expanding surfaces being inclined at an angle of 20° to 45° relative to the plane of the web surface, adjustable end walls being mounted between the adjusting surfaces, the improvement comprising one of the web surfaces, two of the expanding surfaces and two of the adjusting surfaces being part of a one-piece side wall, strand guide rollers being mounted in alignment with and following in casting direction the web surfaces, the expanding surfaces and the adjusting surfaces of the mold, the adjustable end walls having projections which project into the mold space, and guide elements being mounted following the end walls, wherein the guide elements are adjustable in the same direction.

2. The continuous casting plant according to claim 1, each beam blank having end surfaces, wherein the guide elements following the end walls are provided with slide surfaces for the end faces of the beam blank.

3. The continuous casting plant according to claim 1, wherein the guide rollers associated with the expanding surfaces are provided in casting direction in an alternating arrangement with the rollers associated with the web surfaces and the adjusting surfaces.

4. A method for manufacturing beam blanks in a continuous casting plant for use in rolling section steel, the continuous casting plant including a cooled mold and a strand guide arranged following the mold, the mold having two side walls which each define a web surface, two expanding surfaces adjacent the web surface and two parallel adjusting surfaces adjacent the expanding surfaces, end walls being adjustably mounted between the adjusting surfaces, the expanding surfaces of the mold being inclined at an angle of 20° to 45° relative to the plane of the web surface, strand guide rollers being mounted in alignment with and following in casting direction the web surfaces, expanding surfaces and adjusting surfaces of the mold, the adjustable end walls having projections which project into the mold space, and guide elements being mounted following the end walls, each beam blank having a middle web portion and lateral increased thickness portions, the method comprising adjusting the end walls of the continuous casting mold and the strand guide elements following the end walls for changing the profile of the increased thickness portions during the casting operation.

5. The method according to claim 4, further comprising conducting the beam blanks to a finishing rolling mill for the hot rolling of U-sections, sheet piles and beams with parallel flanges.

6. A beam blank manufactured by the method of claim 4.

7. The beam blank according to claim 6, wherein the beam blank has a middle web portion and lateral increased thickness portions, the increased thickness portions widening relative to the middle web portion with a total angle of 40° to 90°, the increased thickness portions defining end surfaces, each end surface defining a recess.

* * * * *